US009966211B1

(12) United States Patent
Tang

(10) Patent No.: US 9,966,211 B1
(45) Date of Patent: May 8, 2018

(54) PRESSURE SWITCH SYSTEM

(71) Applicant: HYDRA-ELECTRIC COMPANY, Burbank, CA (US)

(72) Inventor: John Chick Hong Tang, Monterey Park, CA (US)

(73) Assignee: HYDRA-ELECTRIC COMPANY, Burbank, CA (US)

( * ) Notice: Subject to any disclaimer, the term of this patent is extended or adjusted under 35 U.S.C. 154(b) by 5 days.

(21) Appl. No.: 15/162,479

(22) Filed: May 23, 2016

Related U.S. Application Data

(60) Provisional application No. 62/165,099, filed on May 21, 2015, provisional application No. 62/170,549, filed on Jun. 3, 2015.

(51) Int. Cl.
*H01H 5/20* (2006.01)
*H01H 35/26* (2006.01)
*H01H 5/18* (2006.01)

(52) U.S. Cl.
CPC ..... *H01H 35/2692* (2013.01); *H01H 5/18* (2013.01); *H01H 2203/004* (2013.01); *H01H 2223/002* (2013.01); *H01H 2235/01* (2013.01)

(58) Field of Classification Search
CPC ..... H01H 35/2692; H01H 5/18; H01H 2203/004; H01H 2223/002; H01H 2235/01; H01H 35/34; H01H 35/2614; H01H 35/2657; H01H 35/242; H01H 35/26; H01H 13/06; H01H 13/86; H01H 9/04; H01H 2009/048
USPC ..... 200/83 P, 61.25, 61.86, 235, 81 R, 200/81.9 R, 83 R, 83 Y, 83 W, 195, 407, 200/82 R, 275, 82 A, 82 J, 302.1, 203.2
See application file for complete search history.

(56) References Cited

U.S. PATENT DOCUMENTS 2,147,512 A * 2/1939 Asanuma ..... H01H 33/92 218/112
3,925,755 A * 12/1975 Hata ..... B60C 23/0425 200/61.25
5,917,164 A * 6/1999 Sasaki ..... H01H 35/34 200/302.1
5,950,811 A * 9/1999 Kautz ..... H01H 71/10 200/407

FOREIGN PATENT DOCUMENTS

EP 1775743 A2 * 4/2007 ..... H01H 35/38

* cited by examiner

*Primary Examiner* — Anthony R. Jimenez
(74) *Attorney, Agent, or Firm* — Brooks Acordia IP Law, P.C.; Michael Zarrabian

(57) ABSTRACT

A pressure switch including: a spring blade; a ram pin having an angled bottom surface and laterally restrained in movement, where upward movement of the ram pin engages the spring blade such that the spring blade snap deflects to an engaged position, and where downward movement of the ram pin engages the spring blade such that the spring blade snap deflects to an unengaged position; a ball bearing in contact with the angled bottom surface of the ram pin; and an adjustment screw laterally restraining the ball bearing in movement, where a lateral inward movement of the adjustment screw relative to an outside surface of the pressure switch causes an upward movement of the ram pin, and where a lateral outward movement of the adjustment screw relative to the outside surface of the pressure switch causes a downward movement of the ram pin.

19 Claims, 5 Drawing Sheets

PRESSURE SWITCH SYSTEM

CROSS-REFERENCE TO RELATED APPLICATIONS

This applications claims priority to and the benefit of U.S. Provisional Application No. 62/165,099, filed May 21, 2015 and U.S. Provisional Application No. 62/170,549, filed Jun. 3, 2015, the disclosures of which are incorporated by reference herein for all purposes.

TECHNICAL FIELD

The invention, in its several embodiments, pertains to electric switches, and more particularly to pressure switches.

BACKGROUND

A pressure switch is a switch that closes an electrical contact when a set pressure has been reached on its input. The switch may be designed to make contact either on pressure rise or on pressure fall.

SUMMARY

An exemplary pressure switch may include: a spring blade configured to snap deflect; a ram pin having an angled bottom surface and laterally restrained in movement, where upward movement of the ram pin engages the spring blade such that the spring blade snap deflects to an engaged position, and where downward movement of the ram pin engages the spring blade such that the spring blade snap deflects to an unengaged position; a ball bearing in contact with the angled bottom surface of the ram pin; and an adjustment screw laterally restraining the ball bearing in movement, where a lateral inward movement of the adjustment screw relative to an outside surface of the pressure switch causes an upward movement of the ram pin, and where a lateral outward movement of the adjustment screw relative to the outside surface of the pressure switch causes a downward movement of the ram pin.

In additional exemplary pressure switch embodiments, the spring blade may be a "W" blade. Additional exemplary pressure switch embodiments may include a rivet disposed on the spring blade. In additional exemplary pressure switch embodiments, the rivet may be disposed in the center of the spring blade. In additional exemplary pressure switch embodiments, the rivet may be a gold plated contact. In additional exemplary pressure switch embodiments, the spring blade may be beryllium nickel. In additional exemplary pressure switch embodiments, the rivet may establish an electrical connection with a stud in the engaged position. In additional exemplary pressure switch embodiments, the rivet may break the electrical connection with the stud in the unengaged position.

In additional exemplary pressure switch embodiments, the lateral inward movement of the adjustment screw relative to the outside surface of the pressure switch may cause a corresponding lateral movement of the ball bearing, and a lateral outward movement of the adjustment screw relative to the outside surface of the pressure switch may cause a corresponding lateral movement of the ball bearing. In additional exemplary pressure switch embodiments, the adjustment screw may further include a flat inner surface in contact with the ball bearing and laterally restraining the ball bearing in movement. In additional exemplary pressure switch embodiments, the ball bearing may move upwards in response to increased pressure via a pressure plate. In additional exemplary pressure switch embodiments, the ball bearing may move downwards in response to decreased pressure via the pressure plate.

Additional exemplary pressure switch embodiments may include an amplifier disposed between a top portion of the ram pin and a bottom surface of the spring blade, where upward movement of the ram pin may be amplified by the amplifier to the spring blade, and where downward movement of the ram pin may be amplified by the amplifier to the spring blade. In additional exemplary pressure switch embodiments, the spring blade may be beryllium nickel. In additional exemplary pressure switch embodiments, the spring blade may establish an electrical connection with a stud in the engaged position. In additional exemplary pressure switch embodiments, the spring blade may break the electrical connection with the stud in the unengaged position.

BRIEF DESCRIPTION OF THE DRAWINGS

Embodiments of the present invention are illustrated by way of example and not limitation in the figures of the accompanying drawings, which may not be drawn to scale, and in which.

DETAILED DESCRIPTION

The description herein is made for the purpose of illustrating the general principles of the embodiments discloses herein and is not meant to limit the concepts disclosed herein. Further, particular features described herein can be used in combination with other described features in each of the various possible combinations and permutations. Unless otherwise specifically defined herein, all terms are to be given their broadest possible interpretation including meanings implied from the description as well as meanings understood by those skilled in the art and/or as defined in dictionaries, treatises, etc.

A pressure switch is a switch that closes an electrical contact when a set pressure has been reached on its input. The switch may be designed to make contact either on pressure rise or on pressure fall.

An embodiment of an improved pressure switch system disclosed herein for sensing fluid pressure includes a capsule, diaphragm or piston element that deforms or displaces proportionally to the applied pressure. The resulting motion is applied to a set of switch contacts. The disclosed pressure switch enables simplified testing and/or adjustment by a user to ensure proper function and/or modify set points. The disclosed pressure switch does not require actually varying the pressure being input to the pressure switch for testing purposes (varying the pressure being input to the pressure switch may not be possible and/or practical in many situations).

Figure 1B:
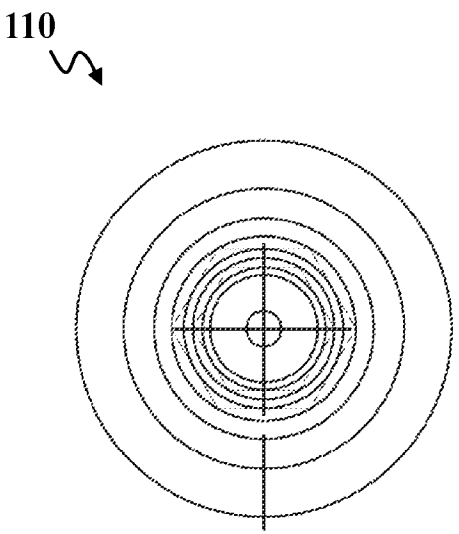
FIG. 1B shows a top view of the pressure switch of FIG. 1A.
Figure 1A:
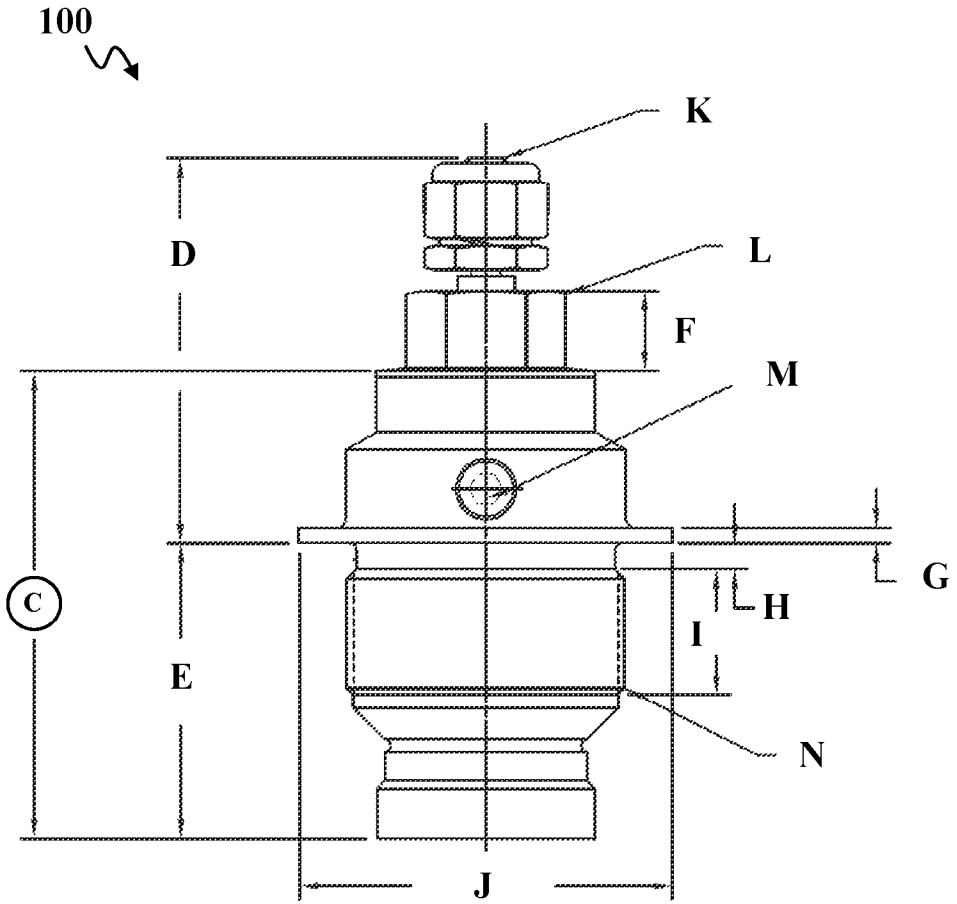
FIG. 1A shows a side view of an embodiment of the pressure switch.
Figure 2B:
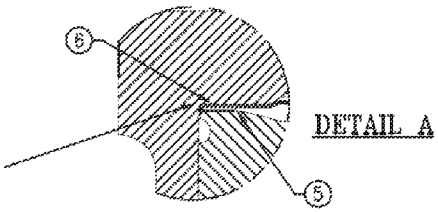
FIG. 2B is an enlarged cross-section of the switch of FIG. 2A about detail A.
Figure 2A:
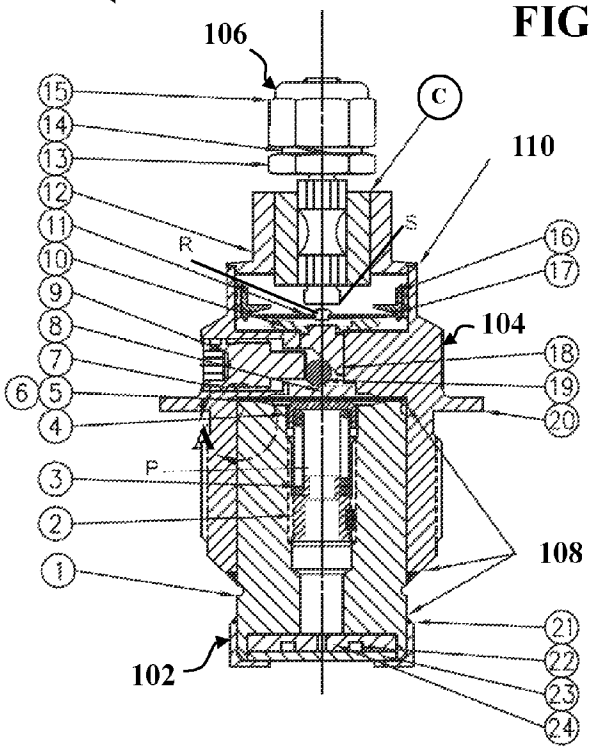
FIG. 2A is a cross-section of the switch of FIG. 1 along the centerline of the length of the pressure switch.
Figure 3B:
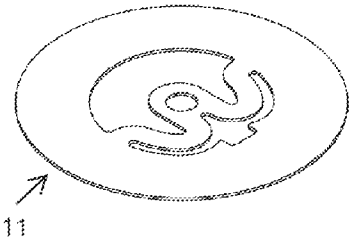
FIG. 3B is a perspective view of the "W" blade spring of FIG. 3A.
Figure 3A:
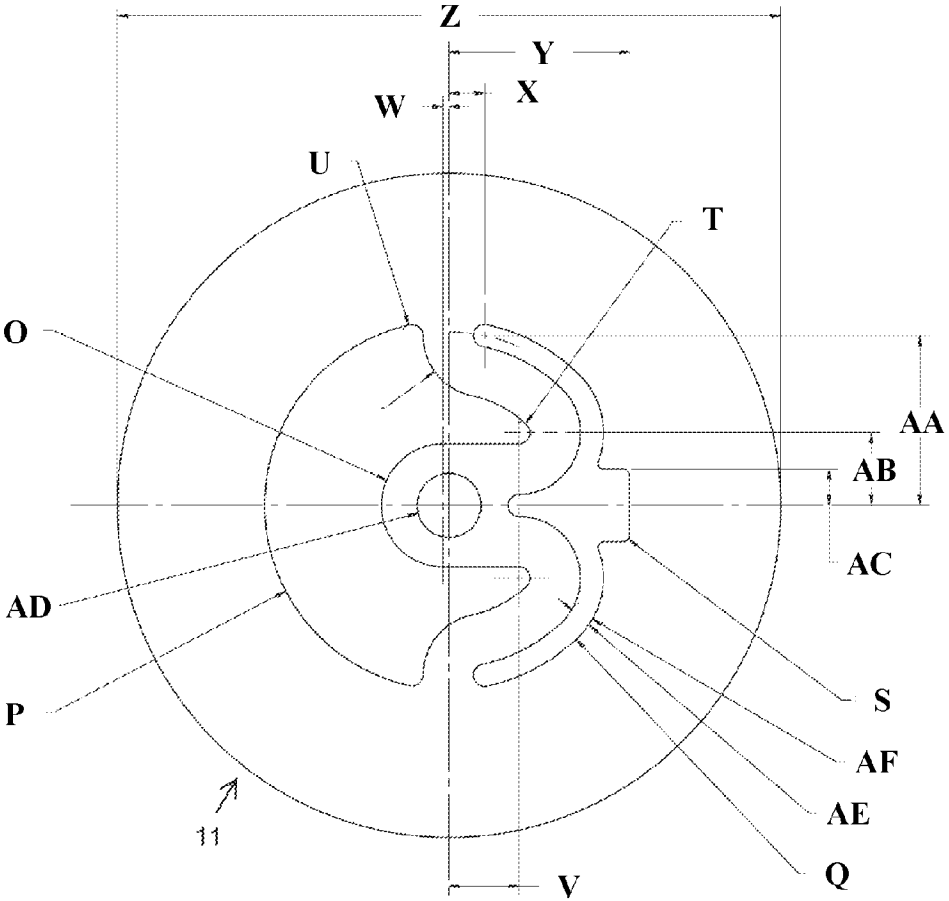
FIG. 3A is a top view of a "W" blade spring of the pressure switch.
Figure 4B:
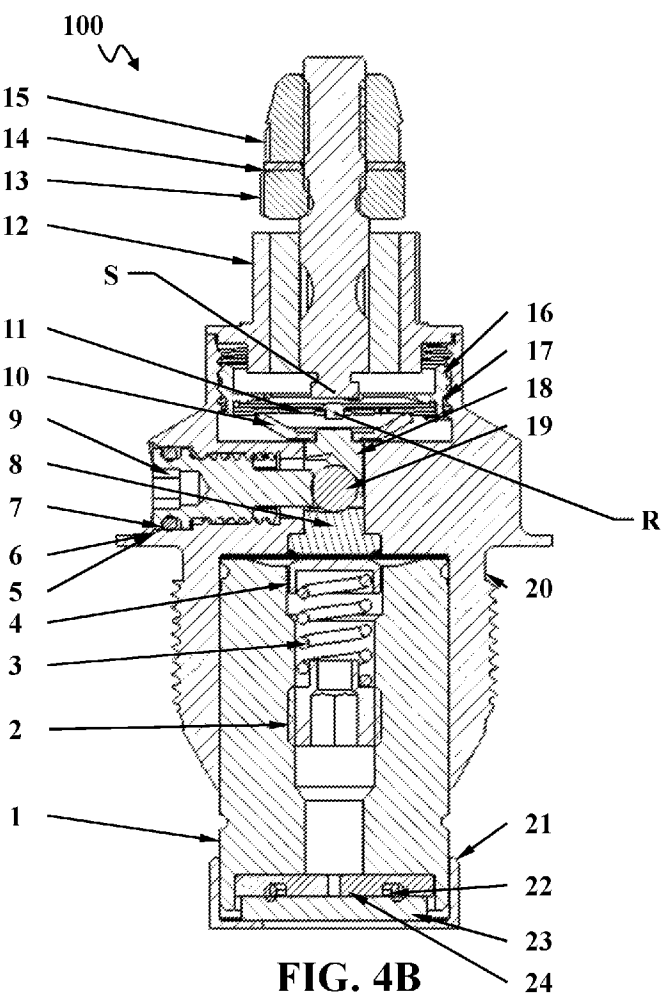
FIG. 4B shows a cross-section of the pressure switch of FIG. 4A in a no-contact mode.
Figure 4A:
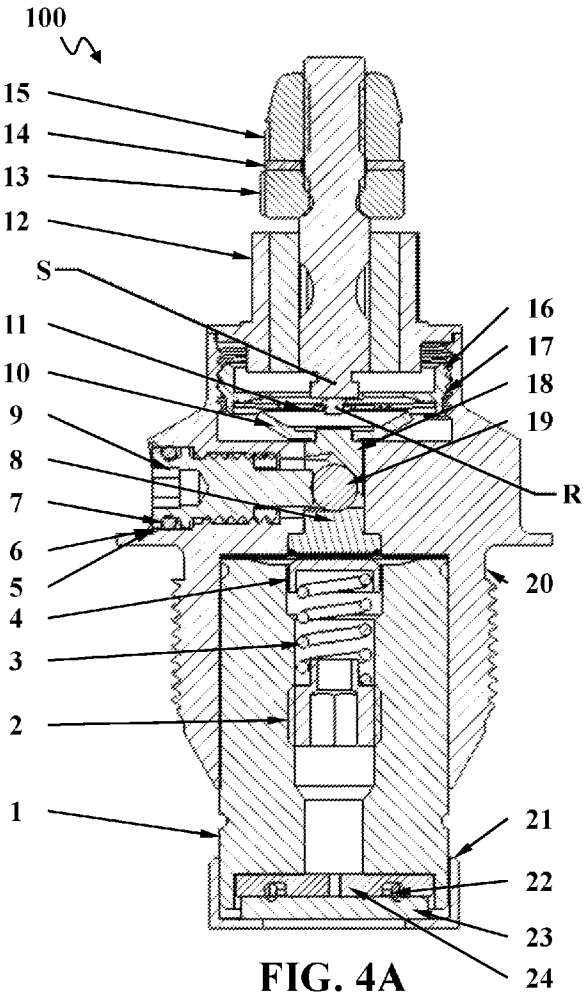
FIG. 4A shows a cross-section of the pressure switch in a contact mode.
Figure 5:
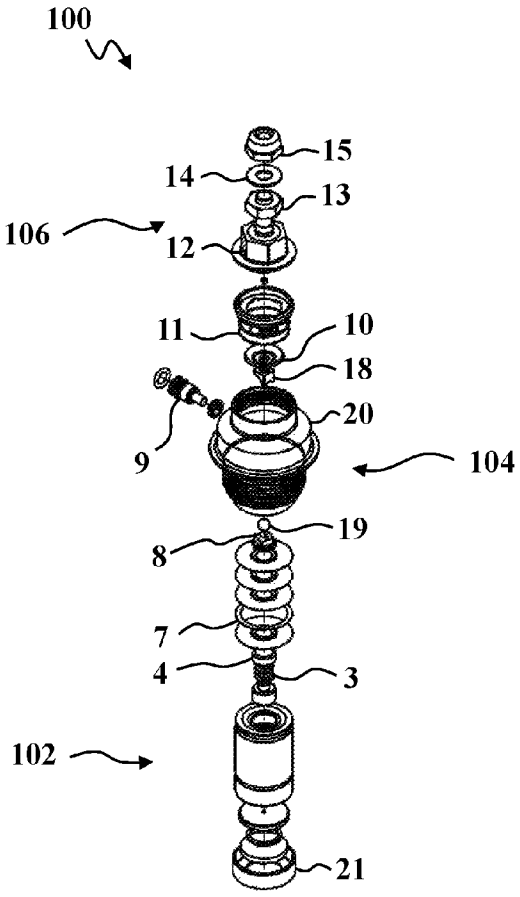
FIG. 5 is an exploded perspective view of an embodiment of the pressure switch.

Embodiments of said improved pressure switch system are disclosed hereinbelow and in the accompanying drawings. FIG. 1A shows a side view of an embodiment of the assembled pressure switch 100. FIG. 1B shows a top view of the pressure switch 100 of FIG. 1A. FIG. 2A is a cross-section of the switch 100 of FIG. 1 along the centerline of the length of the pressure switch. FIG. 2B is an enlarged cross-section of the switch of FIG. 2A about detail A. FIG. 3A is a top view of an embodiment of a "W" blade spring 11 of the pressure switch. FIG. 3B is a perspective view of the "W" blade spring 11 of FIG. 3A. FIG. 4A shows a cross-section of the pressure switch 100 in a contact mode. FIG. 4B shows a cross-section of the pressure switch 100 of FIG. 4A in a no-contact mode. FIG. 5 is an exploded perspective view of an embodiment of the pressure switch 100.

As noted, FIG. 1A shows a side view of an embodiment of the pressure switch 100. One embodiment of the pressure switch 100 may have one or more of the following exterior dimensions, wherein: dimension D is about 1.225 inches, dimension E is about 0.900 inches, dimension F is about 0.250 in., dimension g is about 0.030 in.+/−0.003 in., dimension H is about 0.094 in., dimension I is about 0.380 in.+/−0.010 in., dimension J is about 1.170 in. DIA, K is a 8-32UNC-3A threaded stud, dimension L is about a 0.500 in. hex, dimension M is about a 0.093 in. hex between flats M, and dimension N is about a 0.875-28UN-3A.

Referring to the drawings (for example FIG. 2 and FIG. 5), the pressure switch 100 includes three general switch compartments: a pressure fitting compartment 102, a body compartment 104, and a header assembly compartment 106. The pressure fitting compartment 102 includes a fitting 1, an adjustment screw 2, a helical spring 3, an adjustment shoe 4, a cap 21, an o-ring 22, a filter 23 (e.g., 0.2 micron sintered), and a spacer 24. Pressure from a gas, such as Nitrogen, enters the pressure fitting compartment 102 via the spacer 24, which has a hole in the middle allowing pressurized gas to enter. Pressure then acts upon diaphragms 5, 6, which are located between the pressure fitting compartment 102 and the body compartment 104.

The pressure fitting compartment 102 is laser welded 108 to the body compartment 104. The body compartment 104 includes a body 20, an o-ring 7, a pressure plate 8, an adjustment screw 9, a ball-bearing 19, a ram pin 18, an amplifier system including an amplifier element 10, a spring blade 11, a rivet R, a register 16, and a register ring 17.

In operation, fluid pressure acting on the diaphragms 5, 6 pushes the pressure plate 8 causing the pressure plate 8 to deflect upwards. Pressure on the pressure plate 8 causes the pressure plate 8 to deflect upwards (i.e., towards the ball-bearing 19). Upwards deflection of the pressure plate 8 moves the ball-bearing 19 upwards, wherein the flat surface of the adjustment screw 9 restricts the ball bearing motion to only move upwards or downwards, with no sideways, or lateral, movement. Upward movement of the ball-bearing 19 moves the ram pin 18 upwards towards the spring 11. Similarly, downward movement of the ball bearing 19 moves the ram pin 18 downwards. The ram pin 18 has an angled lower surface in contact with the ball bearing 19.

Rotating the adjustment screw 9 counterclockwise allows the ball bearing 19 to move laterally (e.g., to the left in the drawing) and as a result the ram pin 18 will lower towards the pressure plate 8 due to the angled surface of the ram pin 18. This rotation of the adjustment screw 9 either clockwise or counterclockwise allows the adjustment screw 9 to raise or lower the ram pin 18 in relation to the pressure plate 8. Similarly, this rotation of the adjustment screw 9 either clockwise or counterclockwise allows the adjustment screw 9 to lower or raise the ram pin 18 in relation to the planar spring 11.

Accordingly, the disclosed pressure switch 100 can be manually adjusted via the adjustment screw 9 by a user. The angled ram pin 18, ball bearing 19, and adjustment screw 9 may also be used to turn the pressure switch 100 on or off to test if the switch is operating as desired based on applicable fluid pressure and operational requirements of the switch. Existing pressure switches cannot be manually adjusted and/or tested by users, and must be tested via actually varying the pressure to a switch, which may not be feasible and/or practical in certain circumstances (e.g., as in use for fire extinguishers).

The ram pin 18 transfers movement (e.g., due to fluid pressure) to said amplifier 10, which amplifies the movement of the ram pin 18 into the spring blade 11. The spring blade 11 snap deflects (i.e., deflects rapidly), once it is exposed to a maximum pressure point (e.g., a selectable pressure for deflection due to raise in fluid pressure in the switch). The spring blade 11 snap deflects back to an original position when the applied pressure from the amplifier 10 drops (e.g., due to drop in fluid pressure in the switch), experiencing a decrease in opposing force.

In one embodiment, the spring blade 11 may include a contact rivet R (e.g., a gold plate contact) riveted to a center of the spring 11 as shown. In some embodiments, the contact rivet R may be positioned off center in the spring blade 11. An upward movement (i.e., a snap deflection), of the spring blade 11 towards the stud S due to fluid pressure rise, causes the contact rivet R to make contact with a stud S and complete an electrical circuit through the pressure switch, as shown by example in FIG. 4A (i.e., contact mode). A downward movement (i.e., a snap deflection), of the spring blade 11 away from stud S (due of fluid pressure drop) breaks contact between the contact rivet R and the stud S, which opens said circuit, as shown by example in FIG. 4B (no-contact mode).

In one embodiment of the pressure switch 100, the spring blade 11 essentially eliminates the need for a traditional micro-switch, which micro-switch may include a spring that causes undesired vibrations and can move without proper pressure. In the disclosed embodiment, the spring blade 11 acts as the contact and will not move unless pressure is applied to the spring blade 11 via amplifier element 10. Accordingly, the spring blade 11 and disclosed pressure switch 100 are more resistant to vibration and/or shock as compared to a traditional micro-switch that is sensitive to vibration and shock.

In one embodiment, the body compartment 104 is laser welded 108 to the header assembly compartment 106. The header assembly compartment 106 may be a hermetically sealed header. The header assembly compartment 106 includes a header 12, an adjustment nut 13, a washer 14, a self-adjusting, self-locking nut 15, and a stud S. The header assembly compartment 106 may include a glass to metal seal C.

FIG. 3A is a top view of a "W" blade spring of the pressure switch. One embodiment of the spring blade may have one or more of the following dimensions: dimension O is about R.050 in., dimension P is about R.150 in., dimension Q is about R.150 in. TYP, dimension AF is about R.066 in. TYP, dimension S is about R.005 in. TYP, dimension T is about R.009 in. TYP, dimension U is about R.009 in. TYP, dimension V is about R.050 in., dimension W is about 0.005 in., dimension X is about 0.029 in., dimension Y is about 0.147 in., dimension Z is about ø (diameter) 0.540 in., dimension AA is about 0.138 in. TYP, dimension AB is about 0.059 in., dimension AC is about 0.0295 in. TYP, dimension AD is about 0 (diameter) 0.052 in. thru hole, and dimension AE is about 0.18 in. TYP.

In one embodiment, the pressure switch comprises a pressure switch manufactured from 300 series stainless steel with welded construction.

The pressure switch 100 is a snap-action, all stainless steel gage or absolute pressure switch suitable for operation with Nitrogen at any altitude. Since pressure may be changing slowly and contacts should operate quickly, an over-center mechanism such as a miniature snap-action switch is used to ensure quick operation of the contacts.

Referring to the drawings, in one embodiment the pressure includes an 8-32UNC-3A threaded stud K as its external electrical interface with self-locking hex nut 15 and washer 14. The pressure switch 100 further includes a 0.875-28UN-3A threaded body N and pressure port swaged to house a 0.2 micron sintered filter 23.

In one embodiment, the pressure switch 100 is constructed from 300 series stainless steels and is passivated for corrosion resistance. All structural joints are fusion T.I.G. (Tungsten Inert Gas) or laser welded with semi-automatic welding equipment to assure structural uniformity and reliability. All stresses in components, during the operating environments, are of low magnitude.

Referring to the drawings, in one implementation, the pressure switch 100 includes a corrosion resistant stainless steel body 20 designed, in one example, to be threaded into an aerospace fire extinguisher and welded using, e.g., about a 1.170" diameter flange. The body 20 holds a screw with about 0.093" (2.3622 mm) hex access M for continuity check. The body 20 then tapers to a header flange 12 which houses a singular stud S including a self-tightening nut-washer-nut assembly 13-14-15.

The bottom of the body 20 is laser welded to a stainless steel fitting 1 which can provide adjustment to spring forces internal to the switch during build. After adjustment by the stainless steel fitting 1, a stainless steel cap 21, which holds about a 0.2 micron sintered metal filter 23 sealed by an O-ring 22, is welded to the end of the stainless steel fitting 1.

The pressure switch utilizes multiple Kapton diaphragms 6 and a single stainless steel diaphragm 5 welded to the fitting 1 for pressure sensing. The Kapton diaphragms 6 are preformed to mate with the contour of the pressure plate 8 and compressed between the switch housing and a pressure port. The stainless steel diaphragm 5 provides a hermetically sealed pressure barrier.

Countering the sensing force is a spring 11 made from beryllium nickel, as shown in FIGS. 3A-3B. In some embodiments, the spring 11 may be made from stainless steel for lower-temperature applications. The beryllium nickel spring 11 is constructed from a "W" blade with a gold plated contact rivet R riveted to the center of the spring blade 11. After snap of the spring 11, the contact rivet R establishes the electrical connection with the stationary threaded stud 8-32UNC-3A S sealed in a glass bead header completing an electrical circuit. The spring 11 is a single-pole single-flow. In some embodiments, the spring 11 may be a single-pole, double-flow having two distinct movements. The spring 11 may include a notch, or other feature, to ensure that the spring 11 does not rotate (e.g., in embodiments where the contact is not centered relative to the spring 11 and/or there are multiple contacts).

In one embodiment, in operation the pressure switch 100 operates with a system pressure applied on the multiple layers of Kapton diaphragms 6 and the stainless steel diaphragm 5 which exert a force on the spring 11 through a pressure plate 8, ball bearing 19 and pin 18 through a deflection amplifier 10. As such, the resulting motion is applied through amplifying elements 10 to a set of switch contacts. FIG. 4A shows the pressure switch 100 in contact mode for closing a contact (e.g., for closing an electrical circuit), and FIG. 4B shows the pressure switch 100 in no-contact mode.

The spring 11 is positioned to snap-deflect in the negative slope region of the force-deflection curve such that, after the preload is overcome by the system pressure, any further movement reduces the spring force causing the spring 11 to snap-deflect.

The spring 11 includes said center rivet R which establishes contact to the stud S when spring 11 is deflected upward towards the stud S. FIG. 4A shows the pressure switch in contact mode (i.e., rivet R and stud S are in electrical contact), and FIG. 4B shows the pressure switch in no-contact mode (i.e., rivet R and stud S are not in contact because physical separation there between, due to fluid pressure drop in the switch and the spring 11 snapping back to shape).

Specifically, when the applied fluid pressure drops below a minimum sensing force of the spring 11, de-actuation occurs, wherein the stored potential energy in the spring 11 causes the spring 11 to snap-deflect back to its original position (FIG. 4B). This feature provides positive actuation and eliminates setting drift and contact chattering usually seen in other types of pressure switches.

In one embodiment, the spring 11 is manufactured with an integrated contact which snap deflects to contact the stationary stud S within the switch body 20.

The side access hex screw M, 9 provides a manually actuated ground check feature. To activate the ground check mechanism, an Allen wrench is inserted into the hex recess M. Turning the Allen wrench counter-clockwise releases the ball bearing 19 allowing the ram pin 18 to slide down disengaging the contacts. The opening of the contacts will end an electrical signal indicating the circuit is open and that the switch 100 is working properly.

To activate the switch 100 the access screw M is turned clockwise forcing the ball bearing 19 to raise the ram pin 18 which deflects the spring 11 re-engaging the contacts signaling the suppressor is fully charged. Pressure settings are trim-adjusted to the specified set points by turning the adjustment screw, internal to the pressure port, which increases or decreases the helical spring 3 force on the pressure plate 8 causing an opposite change in pressure settings (i.e., when the spring snap deflects into contact mode due to rising fluid pressure above a first pressure level, and when the spring snap deflects back into no-contact mode due to drop in fluid pressure below a second pressure level, wherein the first and second pressure levels can be essentially the same). The helical spring 3 is concentrically disposed on the pressure plate 8.

FIG. 5 is an exploded perspective view of an embodiment of the pressure switch 100. The pressure switch 100 includes three switch compartments: the pressure fitting compartment 102, the body compartment 104, and the header assembly compartment 106.

Those skilled in the art will appreciate that various adaptations and modifications of the described preferred embodiments can be configured without departing from the scope and spirit of the improved pressure switch system described herein. Therefore, it is to be understood that, within the scope of the embodiments, the improved pressure switch system may be practiced other than as specifically described herein.

What is claimed is:

1. A pressure switch comprising:

a spring blade;

a ram pin having an angled bottom surface and laterally restrained in movement, wherein upward movement of the ram pin engages the spring blade such that a spring blade snap deflects to an engaged position, and wherein downward movement of the ram pin engages the spring blade such that the spring blade snap deflects to an unengaged position;

a ball bearing in contact with the angled bottom surface of the ram pin;

an adjustment screw laterally restraining the ball bearing in movement, wherein a lateral inward movement of the adjustment screw relative to an outside surface of the pressure switch causes an upward movement of the ram pin, and wherein a lateral outward movement of the adjustment screw relative to the outside surface of the pressure switch causes a downward movement of the ram pin; and an amplifier disposed between a top portion of the ram pin and a bottom surface of the spring blade, wherein upward movement of the ram pin is amplified by the amplifier to the spring blade, and wherein downward movement of the ram pin is amplified by the amplifier to the spring blade.

2. The pressure switch of claim 1 the lateral inward movement of the adjustment screw relative to the outside surface of the pressure switch causes a corresponding lateral inward movement of the ball bearing, and wherein a lateral outward movement of the adjustment screw relative to the outside surface of the pressure switch causes a corresponding lateral outward movement of the ball bearing.

3. The pressure switch of claim 1 wherein the adjustment screw further comprises a flat inner surface in contact with the ball bearing and laterally restraining the ball bearing in movement.

4. The pressure switch of claim 1 wherein the ball bearing moves upwards in response to increased pressure via a pressure plate, and wherein the ball bearing moves downwards in response to decreased pressure via the pressure plate.

5. The pressure switch of claim 1 wherein the spring blade is beryllium nickel.

6. The pressure switch of claim 1 wherein the spring blade establishes an electrical connection with a stud in the engaged position, and wherein the spring blade breaks the electrical connection with the stud in the unengaged position.

7. The pressure switch of claim 1 wherein the spring blade is a "W" blade.

8. The pressure switch of claim 7 further comprising:

a rivet disposed on the spring blade, wherein the rivet is disposed in the center of the spring blade.

9. The pressure switch of claim 7 wherein the rivet establishes an electrical connection with a stud in the engaged position.

10. The pressure switch of claim 9 wherein the rivet breaks the electrical connection with the stud in the unengaged position.

11. The pressure switch of claim 1 wherein the rivet is a gold plated contact.

12. The pressure switch of claim 11 wherein the spring blade is beryllium nickel.

13. A pressure switch comprising:

a spring blade;

a ram pin having an angled bottom surface and laterally restrained in movement, wherein upward movement of the ram pin engages the spring blade such that a spring blade snap deflects to an engaged position, and wherein downward movement of the ram pin engages the spring blade such that the spring blade snap deflects to an unengaged position;

an adjustment screw, wherein a lateral inward movement of the adjustment screw relative to an outside surface of the pressure switch causes an upward movement of the ram pin, and wherein a lateral outward movement of the adjustment screw relative to the outside surface of the pressure switch causes a downward movement of the ram pin.

14. The pressure switch of claim 13 further comprising:

a ball bearing in contact with the angled bottom surface of the ram pin, wherein the adjustment screw laterally restrains the ball bearing in movement.

15. The pressure switch of claim 13 wherein the spring blade is a "W" blade.

16. The pressure switch of claim 13 further comprising:

an amplifier disposed between a top portion of the ram pin and a bottom surface of the spring blade, wherein upward movement of the ram pin is amplified by the amplifier to the spring blade, and wherein downward movement of the ram pin is amplified by the amplifier to the spring blade.

17. A pressure switch comprising:

a spring blade;

a ram pin having an angled bottom surface and laterally restrained in movement, wherein upward movement of the ram pin engages the spring blade such that a spring blade snap deflects to an engaged position, and wherein downward movement of the ram pin engages the spring blade such that the spring blade snap deflects to an unengaged position;

a ball bearing in contact with the angled bottom surface of the ram pin; and an adjustment screw laterally restraining the ball bearing in movement, wherein a lateral inward movement of the adjustment screw relative to an outside surface of the pressure switch causes an upward movement of the ram pin, and wherein a lateral outward movement of the adjustment screw relative to the outside surface of the pressure switch causes a downward movement of the ram pin.

18. The pressure switch of claim 17 wherein the spring blade is a "W" blade.

19. The pressure switch of claim 17 further comprising:

an amplifier disposed between a top portion of the ram pin and a bottom surface of the spring blade, wherein upward movement of the ram pin is amplified by the amplifier to the spring blade, and wherein downward movement of the ram pin is amplified by the amplifier to the spring blade.

* * * * *